US009630441B1

(12) United States Patent
King

(10) Patent No.: US 9,630,441 B1
(45) Date of Patent: Apr. 25, 2017

(54) SCRAPBOOK BINDING FOR PAGES OF VARIABLE THICKNESS

(71) Applicant: Kathy King, Pensacola, FL (US)

(72) Inventor: Kathy King, Pensacola, FL (US)

( * ) Notice: Subject to any disclaimer, the term of this patent is extended or adjusted under 35 U.S.C. 154(b) by 0 days.

(21) Appl. No.: 15/143,528

(22) Filed: Apr. 30, 2016

(51) Int. Cl.
*B42D 1/10* (2006.01)
*B42D 1/08* (2006.01)
*B42C 9/00* (2006.01)

(52) U.S. Cl.
CPC ..... *B42D 1/08* (2013.01); *B42C 9/00* (2013.01); *B42D 1/10* (2013.01)

(58) Field of Classification Search
CPC ..... B42D 1/10; B42D 1/08
USPC ..... 281/22–24; 402/500
See application file for complete search history.

(56) References Cited

U.S. PATENT DOCUMENTS 175,327 A 3/1876 Beck
185,066 A 12/1876 Beck
238,560 A 3/1881 Bowman
278,202 A 5/1883 Thorp
335,683 A 2/1886 Chapman
387,917 A 8/1888 Ranshaw
387,918 A 8/1888 Ranshaw
393,664 A * 11/1888 Rose ..... B42F 11/02 281/24
470,866 A 3/1892 Hafely
872,547 A 12/1907 Uffner
887,448 A 5/1908 Willinger
928,518 A 7/1909 Howell
1,170,793 A 2/1916 Ballantine
1,333,231 A * 3/1920 Ulrich ..... B42D 1/10 206/425
1,415,429 A 5/1922 Cueny
2,301,422 A 11/1942 Lichter
2,310,725 A 2/1943 Widder et al.
2,516,045 A 7/1950 Bryan et al.
3,212,505 A * 10/1965 Toman ..... B42D 1/10 281/21.1
3,279,472 A * 10/1966 Toman ..... B42D 1/10 281/21.1
3,279,474 A * 10/1966 Toman ..... B42D 1/10 281/21.1
4,140,565 A 2/1979 Parker et al.
4,961,666 A * 10/1990 Pitts ..... B42F 11/00 402/500
5,248,164 A * 9/1993 Lepretre ..... B42D 1/10 281/22

(Continued)

FOREIGN PATENT DOCUMENTS

GB 361434 A * 11/1931 ..... B42D 1/10
GB 2142878 A * 1/1985 ..... B42D 1/10
NL WO 2013125946 A1 * 8/2013 ..... B42D 1/10

*Primary Examiner* — Kyle Grabowski
(74) *Attorney, Agent, or Firm* — Grace J. Fishel

(57) ABSTRACT

A book binding for a scrapbook with hinges separated by gussets and an anchored end and a free end that may be bent to the right or left to accommodate pages of different thickness such that the pages lie flat and the covers of the scrapbook are substantially parallel when the scrapbook is closed. The binding is constructed from sheet material scored into groups of four equally spaced panels separated by a panel forming the gusset. The four equal width panels are folded along a longitudinal center score line and adhesively secured together to form the hinges.

10 Claims, 5 Drawing Sheets

(56) References Cited

U.S. PATENT DOCUMENTS

| | | | | |
|---|---|---|---|---|
| 5,683,194 | A * | 11/1997 | Emmel | B42F 11/00 402/500 |
| 6,010,157 | A | 1/2000 | Pierson et al. | |
| 8,104,669 | B2 | 1/2012 | Christensen et al. | |

* cited by examiner

SCRAPBOOK BINDING FOR PAGES OF VARIABLE THICKNESS

STATEMENT REGARDING FEDERALLY SPONSORED RESEARCH

Not Applicable.

BACKGROUND

1. Field of the Invention

The present invention relates to a book binding for use by scrapbookers in binding pages of variable thickness including premade elements, such as chipboard album pages and specialty die cut pages.

2. Brief Description of the Prior Art

A scrapbooking hidden hinge system has been developed for attaching pages in an album but the system is not adapted for binding pages that differ in thickness. Chipboard and die cut elements are hot products in the paper crafting world to add extra interest to projects. Since chipboard and die cut elements are raised from the page, they attract more attention than rub-ons or other flat scrapbook embellishments. But because chipboard and die cuts make the pages thicker it is difficult to construct an aesthetically pleasing scrapbook where one-of-a-kind pages lie substantially flat and the front and rear covers are parallel when the book is closed.

BRIEF SUMMARY OF THE INVENTION

In view of the above, it is an object of the present invention to provide a book binding for binding thick pages, including ones that differ in thickness. Another object is to provide a book binding for use in constructing an aesthetically pleasing scrapbook with pages of different thickness lying substantially flat and front and rear covers substantially parallel when the scrapbook is closed. Other objects and features of the invention will be in part apparent and in part pointed out hereinafter.

In accordance with the invention, a book binding for a scrapbook is formed from a sheet of flexible material such as cardstock or Tyvek. Tyvek is a brand of plastic sheet material formed of high density polyethylene fibers and is a registered trademark of DuPont. The binding has a wingspan at opposite ends adapted for attachment to the scrapbook and a plurality of hinges separated by gussets for spacing pages attached to the hinges by a predetermined amount.

Each hinge is formed from a group of four equal width longitudinal panels separated from an adjoining set of four panels by a longitudinal panel forming the gusset. Each said group of four equal width panels is folded along a longitudinal center score line and adhesively secured together with double sided adhesive tape having a width no greater than the width of the equally spaced panels to form hinges with an anchor end and a free end. Each hinge has a score line between a first and second and a third and fourth of the four equal width longitudinal panels about which the hinge may be longitudinally flexed in opposite directions for further adjusting the spacing between the pages.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
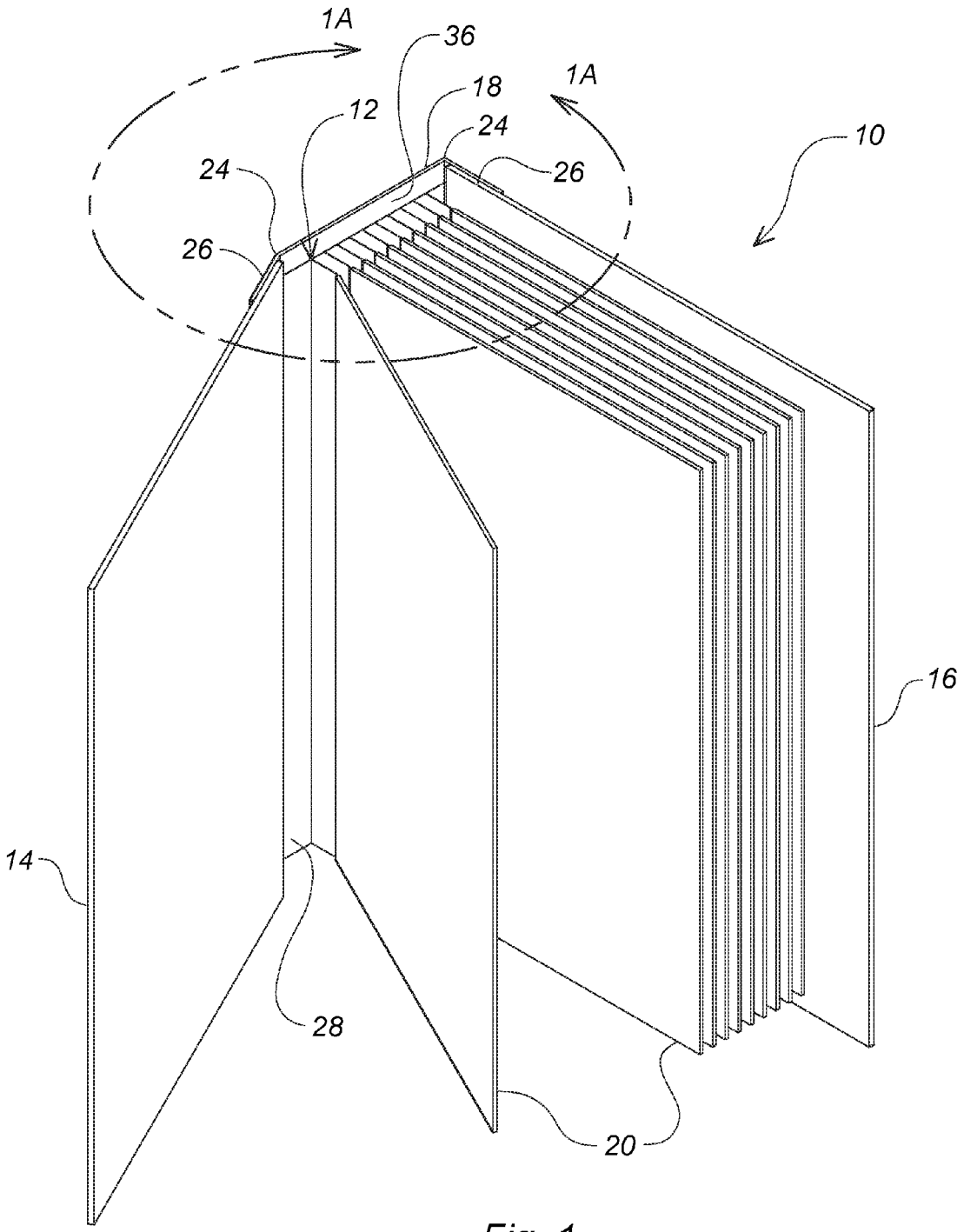
FIG. 1 is a perspective view of a scrapbook with a book binding in accordance with the present invention.
Figure 1A:
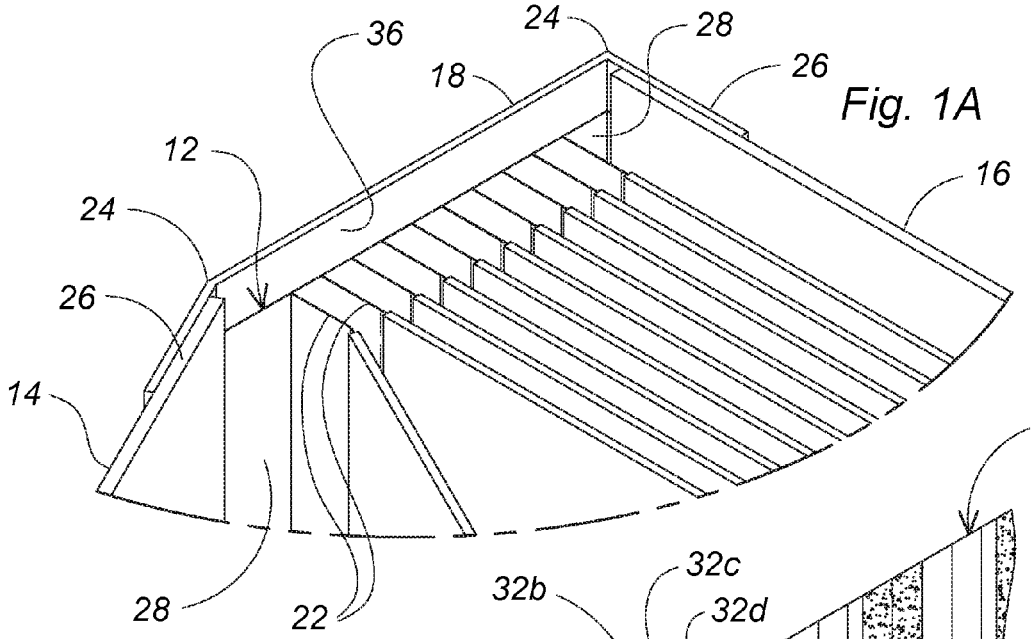
FIG. 1A is a detail taken along the line of 1A-1A in FIG. 1.

Referring to the drawings more particularly by reference character, reference numeral 10 refers to a scrapbook having a binding 12 in accordance with the present invention. As seen in FIG. 1, scrapbook 10 has a front cover 14, a rear cover 16 and a spine cover 18 preferably formed of a stiff material such as chipboard. Front and rear covers 14, 16 are shaped and dimensioned to cover a stack of sheets 20 to be bound on hinges 22 as pages in the scrapbook. Front and rear covers 14, 16 are commonly made in a conventional shape, that is rectangular, however the covers may take a variety of shapes. Spine cover 18 is U-shaped in configuration with longitudinal creases 24 forming hinge lines along which spine cover is attached to a side edge 26 of front and rear covers 14, 16 after binding 12 is attached to spine cover 18.

Figure 2:
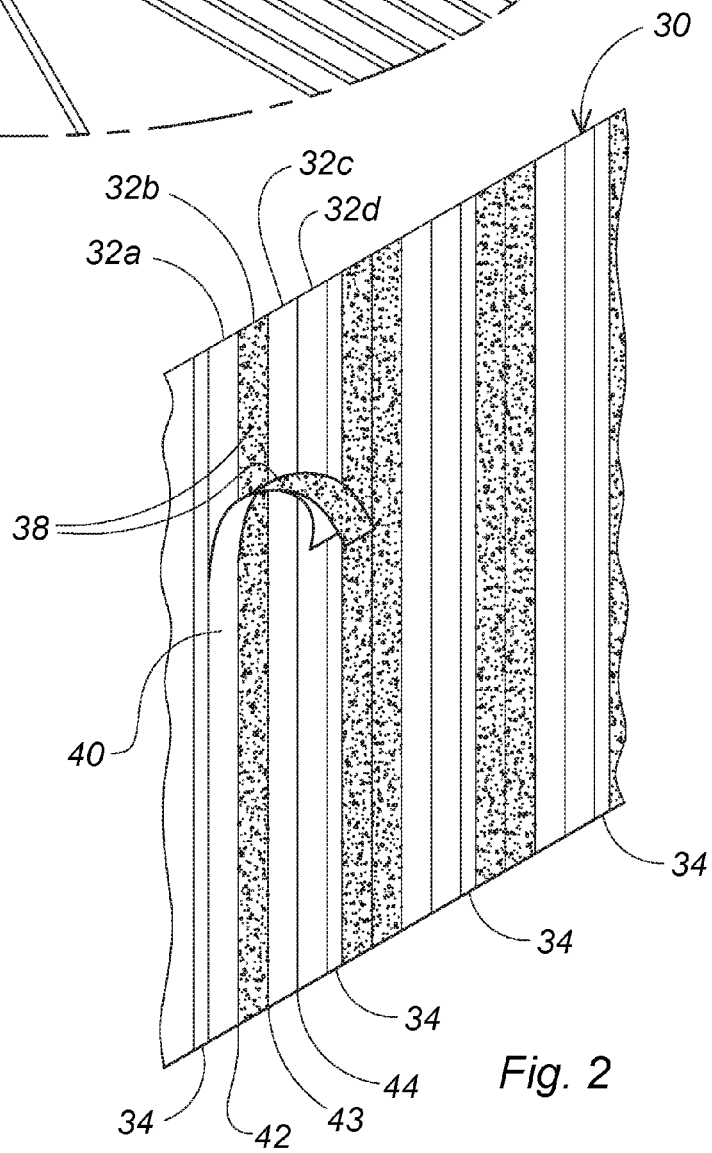
FIG. 2 is a perspective view of a rear side of a sheet of material scored into panels separated by gussets to which double sided tape is selectively applied.

Binding 12 has wingspans 28 at opposite side edges for attachment to spine cover 18 and a plurality of hinges 22. Binding 12 is formed from a flexible sheet material such as cardstock, Tyvek or the like. Depending on the number of hinges 22 needed to attach sheets 20 and the size of the sheet material available, binding 12 may be constructed from a plurality of pieces linked end to end. The construction of hinges 22 is as follows: As shown in FIG. 2 starting inboard wingspan 28 at a first end of sheet material 30 (or first piece of sheet material 30), the piece is longitudinally scored into four equal width panels 32*a*, 32*b*, 32*c* and 32*d* followed by a panel 34 the width of which will form a gusset between hinges 22 as will become more apparent. For example the piece may be scored starting 2 inches from the end in groups of four ½ inch panels separated by a ¼ inch panel. This pattern is repeated the length of the piece to second wingspan 28. When binding 12 is formed from separate pieces two of the four equal width panels 32*a* and 32*b* are provided at the end of the first piece and two of the four equal width panels 32*c* and 32*d* are provided at the beginning of each adjoining piece.

The scored side of sheet material 30 forms the side of binding 12 facing an inside 36 of spine cover 18. To form hinges 22, a double sided adhesive tape 38 with a protective sheet 40 having a width no larger than the width of panels 32*a*-32*d* (e.g., ½ inch) is applied to each of the first two of the four equal width panels 32*a*, 32*b* working along the length of the strip of sheet material 30. Alternatively double sided adhesive tape 38 having a width no larger than the width of the first two panels 32*a*, 32*b* (e.g., 1 inch) may be used. Care should be given not to cover score line 43 between panels 32*b* and 32*c*.

Figure 3:
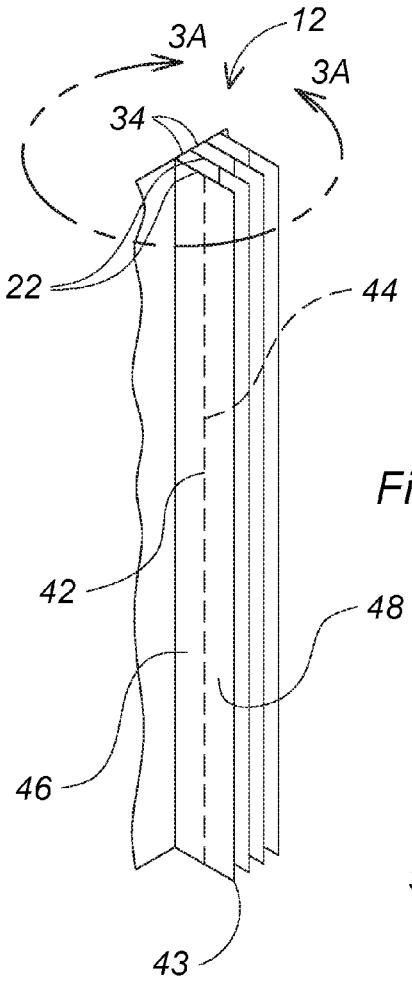
FIG. 3 is a perspective view of hinges formed on the front side of the sheet of material after the panels between the gussets have been stuck together.
Figure 3A:
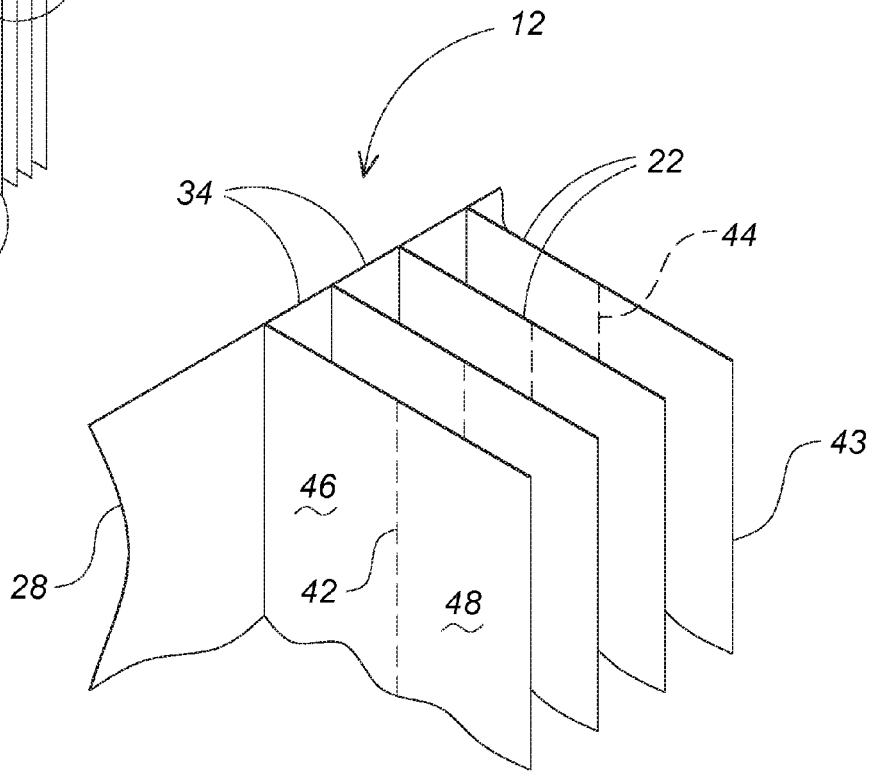
FIG. 3A is a detail taken along the line of 3A-3A in FIG. 3.
Figure 4:
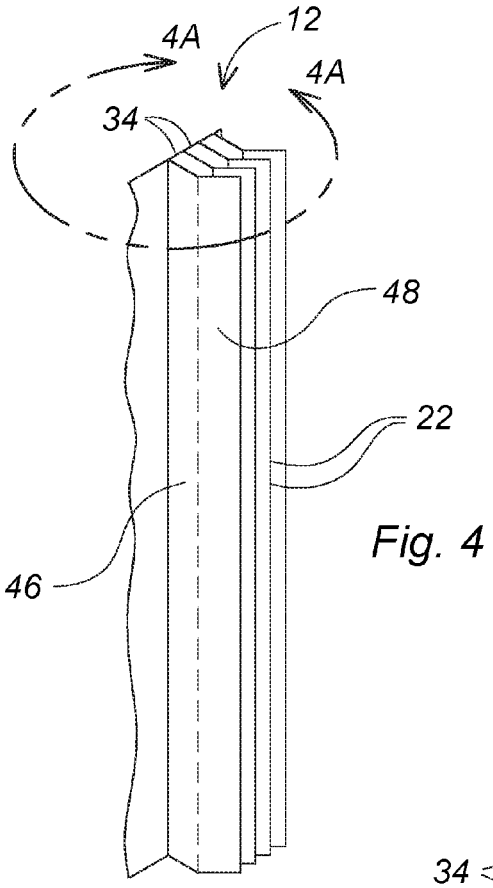
FIG. 4 is similar to FIG. 3 but shows the free ends of the hinges flexed to the right.
Figure 4A:
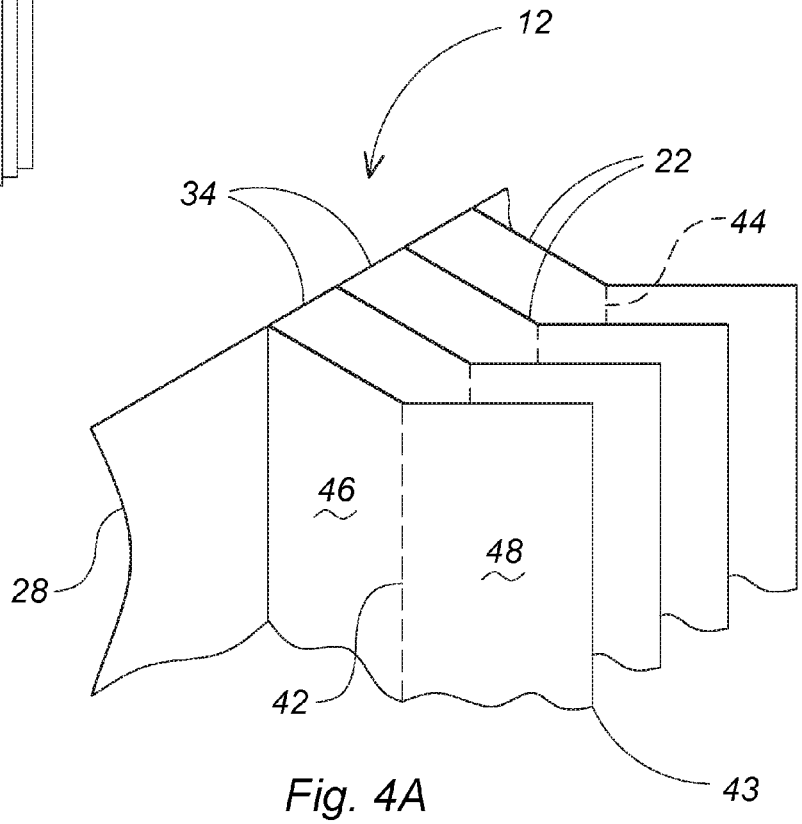
FIG. 4A is a detail taken along the line of 4A-4A in FIG. 4; and, FIG. 5 is a top view of the scrapbook in closed position.
Figure 5:
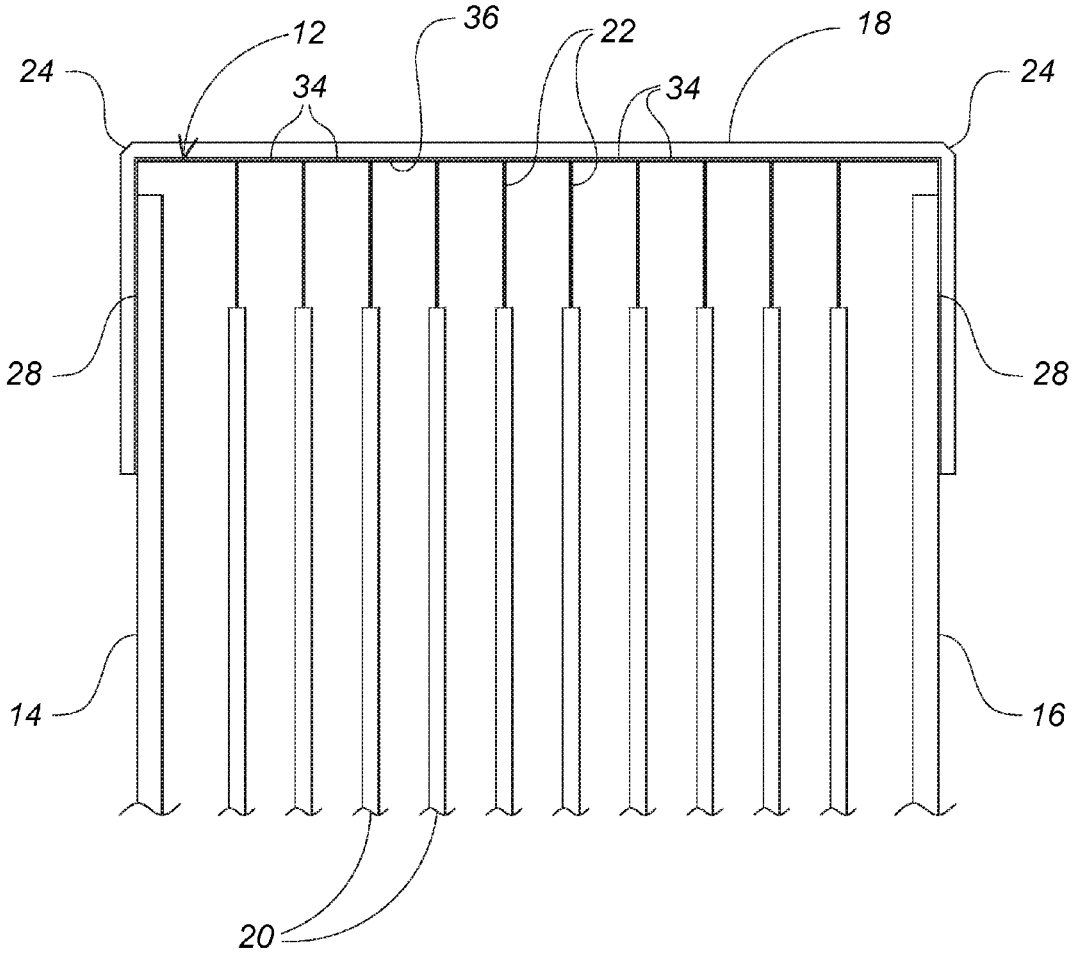

Working from the scored side of sheet material 30 and starting at the first end, protective sheet(s) 40 are removed from the first two panels 32*a* and 32*b* and the first group of four equal width panels is folded along score line 43 between the first two panels 32*a* and 32*b* and the second two panels 32*c* and 32*d*. The panels 32*a* and 32*b* with double sided adhesive tape 38 are pressed against the other two panels 32*c* and 32*d* to form a hinge 22 on the opposite side of the sheet material 30 as seen in FIGS. 3 and 3A. The procedure is then repeated along the sheet of material 30 to form a row of hinges separated by gussets 34. When binding 12 is formed from separate pieces, the last two equal spaced panels 32*a* and 32*b* are adhered to the first two equal spaced panels 32*c* and 32*d* of the adjoining piece until second wingspan 28 is reached. Each of hinges 22 may be flexed as shown in FIGS. 4 and 4A along score lines 42 and 44 positioned between an anchored end 46 and a free end 48. It will apparent to those skilled in the art that hinges may be formed by attaching double sided adhesive tape 38 to the second set of two panels (e.g., 32*c* and 32*d*) or to one of panels 32*a*, 32*b* and to one of panels 32*c*, 32*d* or to all the panels and pressing the panels together.

After binding 12 is constructed as described above, it is attached to spine cover 18. This may be accomplished by gluing the binding to spine cover 18 or by applying double sided tape 38 over the scored side of the sheet material 30 including wingspans 28 and pressing binding 12 against spine cover 18. Spine cover 18 may then be attached to front and rear covers 14, 16 with glue or double sided tape with wingspans 28 sandwiched between the spine cover and the front and rear covers.

With binding 12 and front and rear covers 14, 16 attached to spine cover 18, scrapbook 10 is then ready for attachment of sheets 20 to hinges 22 with glue, double sided adhesive tape, staples, brads or the like. While all of the hinges shown in FIGS. 4 and 4A are shown with free end 48 flexed to the right, depending on the thickness of the scrapbook items attached to the sheet, free end 48 of the hinge may be flexed to the left. In this manner, it is possible by flexing some hinges right and others to the left to accommodate scrapbook items of various thicknesses on different pages and construct scrapbook 10 such that the sheets lie substantially flat and front and rear covers 14, 16 are generally parallel when the scrapbook is closed, providing a superior aesthetic appearance.

In the above description, specific details are set forth in order to provide a thorough understanding of the present disclosure. It will be apparent to a person of ordinary skill in the art that these specific details need not be employed, and should not be construed to limit the scope of the disclosure. Hence as various changes could be made in the above constructions without departing from the scope of the invention, it is intended that all matter contained in the above description or shown in the accompanying drawings shall be interpreted as illustrative and not in a limiting sense.

What is claimed is:

1. A book binding for a scrapbook, said binding formed from a sheet of flexible material having a wingspan at opposite ends adapted for attachment to the scrapbook and a plurality of hinges separated by gussets of predetermined width, each hinge formed from a group of four equal width longitudinal panels separated from an adjoining set of panels by a longitudinal panel forming the gusset, each said group of four equal width panels folded along a longitudinal center score line and adhesively secured together with double sided adhesive tape to form hinges with an anchor end and a free end, each said hinge having a score line between a first and second and a third and fourth of the four equal width longitudinal panels about which the hinge may be longitudinally flexed in opposite directions.

2. The book binding of claim 1 wherein the double sided adhesive tape is applied to the first two or second two of the four equal width panels and includes a peal away protective sheet.

3. The book binding of claim 1 wherein the four equal width panels have a width of ½ inch, the panel forming the gusset has a width of ¼ inch and the double sided adhesive tape has a width no greater than ½ inch or 1 inch.

4. The book binding of claim 1 wherein the sheet of flexible material forming the book binding is a plastic sheet.

5. The book binding of claim 4 wherein the sheet of flexible material is Tyvek.

6. A scrapbook having a front cover, rear cover, a spine cover and a binding, said front and rear cover shaped and dimensioned to cover a stack of sheets, said spine cover attached to the front and rear covers along a side edge of the front and rear covers, said binding formed from a sheet of flexible material having a wingspan and a plurality of hinges separated by gussets of predetermined width attached to the spine cover, each hinge formed from a group of four equal width longitudinal panels separated from an adjoining set of panels by a longitudinal panel forming the gusset, each said group of four equal width panels folded along a center score line and adhesively secured together with double sided adhesive tape to form hinges with an anchor end and a free end, each said hinge having a score line between a first and second and a third and fourth of the four equal width longitudinal panels about which the hinge may be longitudinally flexed in opposite directions, said binding adhesively attached to the spine cover, and said loose sheets attached to the free end the hinges, whereby the hinge creased along the score line between the first and second and third and fourth panels allows the free end of the hinge to be flexed such that pages of different thicknesses lie substantially flat and the front and rear covers are generally parallel when the scrapbook is closed.

7. The scrapbook of claim 6 wherein the binding is adhesively attached to an inside surface of the spine cover with double sided adhesive tape.

8. The scrapbook of claim 6 wherein the front and rear covers and the spine cover are formed of chipboard.

9. The scrapbook of claim 6 wherein the sheet material of flexible material forming the binding is Tyvek.

10. A scrapbook having a front cover, rear cover, a spine cover and a binding, said front and rear cover formed of chipboard and shaped and dimensioned to cover a stack of sheets, said spine cover formed of chipboard with longitudinal creases forming hinge lines, said spine cover attached to the front and rear covers along a side edge of the front and rear covers, said binding formed from a sheet of flexible plastic material, said binding having a wingspan and a plurality of hinges separated by gussets of predetermined width attached to the spine cover, each hinge formed from a group of four equal ½ inch wide longitudinal panels separated from an adjoining set of panels by a longitudinal panel ¼ inch wide forming the gusset, each said group of four equal width panels folded along a center score line and adhesively secured together with double sided adhesive tape to form hinges with an anchor end and a free end, each said hinge having a score line between a first and second and a third and fourth of the four equal width longitudinal panels about which the hinge may be longitudinally flexed in opposite directions, said binding adhesively attached to the spine cover with double sided adhesive tape, and said loose sheets formed of cardstock, at least one of which differs in thickness from the other loose sheets, said loose sheets attached to the free end of the hinges.

* * * * *